United States Patent [19]

Suzuki et al.

[11] Patent Number: 4,542,320

[45] Date of Patent: Sep. 17, 1985

[54] CATHODE RAY TUBE

[75] Inventors: Hiroshi Suzuki, Nagaokakyo; Masao Natsuhara, Ohtsu; Chisato Kurusu, Suita, all of Japan

[73] Assignee: Matsushita Electronics Corporation, Kadoma, Japan

[21] Appl. No.: 579,504

[22] Filed: Feb. 13, 1984

[30] Foreign Application Priority Data

Feb. 14, 1983 [JP] Japan ..... 58-23447

[51] Int. Cl.[4] ..... H01J 29/46; H01J 29/56

[52] U.S. Cl. ..... 315/15; 313/449

[58] Field of Search ..... 315/14, 15, 382; 313/447, 449, 452

[56] References Cited

U.S. PATENT DOCUMENTS 2,825,837 3/1953 Dudley .

2,935,636 5/1960 Knechtli .

3,417,199 12/1968 Yoshida et al. ..... 315/14

*Primary Examiner*—Theodore M. Blum

*Attorney, Agent, or Firm*—Cushman, Darby & Cushman

[57] ABSTRACT

Distance between the second grid (G2) and the third grid (G3) is selected very short and electron beam passing apertures of the second grid (G2) and the third grid (G3) are selected small; the cathode ray tube has small beam spot both at small current and large current operations.

7 Claims, 6 Drawing Figures

CATHODE RAY TUBE

BACKGROUND OF THE INVENTION

1. Field of the Invention

The present invention generally relates to an improvement of a cathode ray tube, and particularly to a cathode ray tube of high resolution.

2. Description of the Prior Art

A bipotential type electron gun is widely used for color picture tubes. The bipotential type electron gun has good high tension characteristics, and a good focussing characteristic as long as it is used at a low beam current. However, when it is used at a high beam current for reproducing a picture of high brightness, a considerable deterioration of resolution is caused due to an excessive enlargement of beam spot which is called "blooming".

The above-mentioned is elucidated with reference to attached FIG. 1, which is a schematic sectional view along the axis of a bipotential type electron gun of prior art. Thermal electrons emitted from the cathode 1 undergo a converging action of an electrostatic lens 4 called cathode lens which is constituted of the cathode 1, a first grid (G1) as a control grid 2 and a second grid (G2) as an acceleration electrode 3. Accordingly, the electrons cross the axis of the electron gun to produce a crossover 5, and then the electrons travel diverging therefrom. The electrons are then preliminarily focussed by a pre-focus lens 7 produced between the second grid (G2) 3 and a third grid (G3) 6 as a focussing grid. Then, the pre-focussed electron beam is led to a main lens 9 constituted with the third grid (G3) 6 and a fourth grid (G4) 8 as a final acceleration grid. The main lens 9 produces a beam spot 12, which is a virtual image 10 of the crossover 5 made by the pre-focus lens, on a fluorescent screen.

It is well-known in electron gun design that in cases where diameter $\phi$ of electron beam 12' at the main lens 9 is either too small or too large, the diameter of the beam spot 12 becomes large. Accordingly, it is an important matter to control the beam divergence angle a' by pre-focus lens 7 thereby to control the electron beam diameter $\phi$ to an appropriate value.

In order to obtain a beam spot 12 of a small diameter, the diameter of the virtual image of the crossover 10 must be small; but this becomes more difficult as the beam current increases. In a bipotential type electron gun the potential of the third electron (G3) is only about 10 KV, and therefore the virtual image of the crossover is likely to become large as the beam current increases, thereby increasing the diameter of the beam spot 12.

Relation between the pre-focus lens 7 and the virtual image 10 of the crossover is shown in FIG. 2, wherein curves 13*a* and 13*b* show paths of electrons from the central part of the cathode 1, and curves 14*a* and 14*b* show paths of the electrons from the peripheral region of the cathode. The above-mentioned pre-focus lens 7 comprises a convergence lens part 7*a* formed at the outlet part of the second grid (G2) 3 and a divergence lens 7*b* formed at the inlet part of the third electrode (G3) 6.

Thermal electrons emitted from the central part of the cathode do not undergo much effect from the cathode lens 4, and produce a crossover 5*a* at a point which is more distant from the face of the cathode 1. This crossover 5*a* is located in the convex lens 7*a*, and therefore the electron beams emitted from the central part of the cathode are not subject as much to a converging action of the convex lens 7*a*, and thereafter are subject to diverging at the concave lens part 7*b*. Therefore, the electron beams emitted from the central part of the cathode do not substantially receive influence of the pre-focus lens 7.

On the other hand, thermal electrons emitted from the relatively peripheral region of the face of the cathode 1 is greatly influenced by spherical aberration of the cathode lens 4, to produce a crossover 5*b* at a part nearer to the surface of the cathode 1. The crossover 5*b* is located at a position before entering the convex lens 7*a*, and coming into the convex lens 7*a* with a relatively large diverging angle a. After converged by the convex lens 7*a*, the electron beams are made slightly divergent by the concave lens 7*b*, thereby coming in the third grid (G3) 6 with a divergence angle a' and thereafter comes into the main lens 9.

Diameter of the virtual image 10 of the crossover is determined graphically by drawing a set of straight lines 13*a'* and 13*b'*, which are extended leftward from the straight line part of the electron paths 13*a* and 13*b*, and another set of straight lines 14*a'* and 14*b'*, which are also extended leftward from the straight line part of the electron paths 14*a* and 14*b*. The distance between the crossing positions of the above two sets of the straight lines gives the diameter of the virtual image 10 of the crossover. The diameter of the virtual image 10 becomes larger as spherical aberrations of the cathode lens 4 and pre-focus lens 7 become larger.

Generally speaking, lens action of an electron lens formed by an axially symmetrical electric field is given by the following equation (1):

$$A = (1/\sqrt{V_b}) \int_a^b (V''/\sqrt{V})\, dZ. \tag{1}$$

Wherein

V is potential on the axis of electron gun,

Z is distance on the axis from the cathode face,

V'' is the second derivative of the axial potential V, that is $V''=(d^2V)/(dZ^2)$, a is axial position at the inlet position of the lens, b is axial position of the outlet of the lens, and $V_b$ is the axial potential at the lens outlet position.

FIG. 3 shows the axial potential V and its second derivative V'' as a function of axial distance Z, and a lower peak 15 corresponds to the part of the cathode lens 4, a higher peak 16 and a valley 17 correspond to the region of the pre-focus lens 7. The positive maximum 16 of the curve of the second derivative V'' lies at the outlet part of the second grid (G2) 3, i.e., at the position $Z_1$, and has the minimum (negative peak) 17 at the part of the inlet part of the third electrode (G3) 6. The lens action is determined by the integration of $V''/\sqrt{V}$, and accordingly, the lower the axial potential V is, the stronger the lens action. The pre-focus lens 7 as a whole functions as a convex lens.

Generally speaking, the spherical aberration of an electron lens is smaller when its aperture is larger and change of electric field forming the electron lens is more gradual. Accordingly, in the prior arts, the electron beam passing apertures of the second grid (G2) 3 and the third grid (G3) 6 were designed as large as possible, and distance between the second grid (G2) and the third grid (G3) were deermined to be as large as possible to produce a moderate electric field distribution. That is, in the prior arts, the distance between the position $Z_1$ of the maximum potential and $Z_2$ of the minimum potential were determined to be more than 1.5 $D_1$ where $D_1$ is the electron beam passing aperture of the first grid (G1), and the electron beam passing aperture of the third grid (G3) was selected to have a diameter more than twice that of the electron passing aperture of the second grid (G2). In addition and the first derivative of axial potential was kept less than $5\times10^4$ V/cm.

SUMMARY OF THE INVENTION

The purpose of the present invention is to provide a high resolution cathode ray tube with a reduced diameter of beam spot at a large beam current by making the distance between the second grid (G2) and the third grid (G3) very short and electron beam passing apertures of the second grid (G2) and the third grid (G3) small.

A cathode ray tube in accordance with the present invention comprises an electron gun, fluorescent screen and an evacuated enclosure enclosing the electron gun, and the fluorescent screen therein, the electron gun comprising at least of a cathode, a first grid (G1) as a control grid, a second grid (G2) on which an accelerating potential is to be applied, a third grid (G3) on which a focussing potential is to be applied, which are disposed in this sequential order and impressed with such predetermined potentials that:

maximum of the first derivative of the axial potentials of the electron gun within a range between the second grid (G2) and the third grid (G3) is in a range from $5\times10^4$ V/cm to $5\times10^5$ V/cm, and maximum value and minimum value of the second derivative of the axial potential of the electron gun are located at the distances on the axis determined from following relations:

$$1.0\ D_1 \leqq Z_1 \leqq 2.0 D_1 \text{ and}$$

$$0.5\ D_1 \leqq Z_2 - Z_1 \leqq 1.2\ D_1,$$

wherein $Z_1$ and $Z_2$ are the distance on the axis of the electron gun from electron beam emitting face of the cathode to points of the maximum value and a minimum value of the second derivative, respectively, and $D_1$ is the diameter of electron passing aperture of the first grid (G1).

DESCRIPTION OF THE PREFERRED EMBODIMENTS

Figure 2:
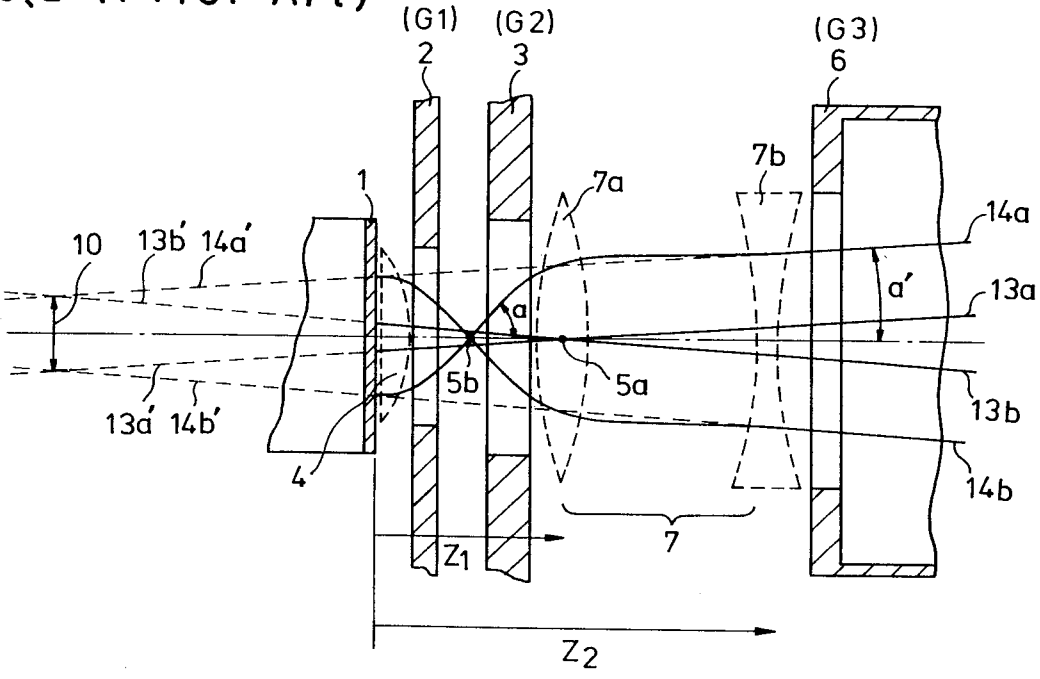
FIG. 2 (Prior Art)
FIG. 2 is the enlarged sectional view of the electron gun of FIG. 1.
Figure 3:
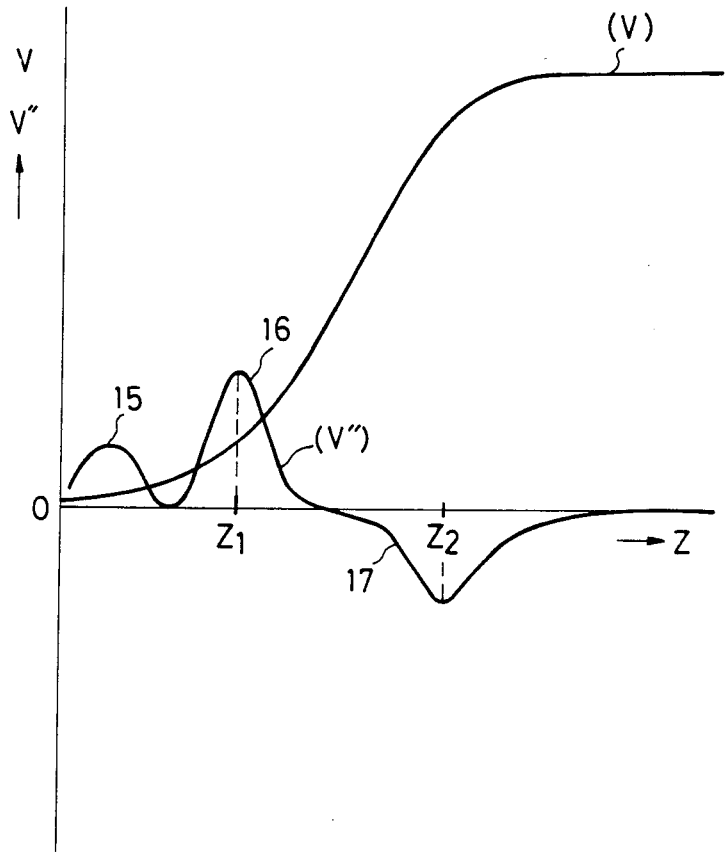
FIG.3 (Prior Art)
FIG. 3 is a graph showing axial potential distribution and axial distribution of second derivative of the potential of the electron gun of FIG. 1 and FIG. 2.
Figure 4:
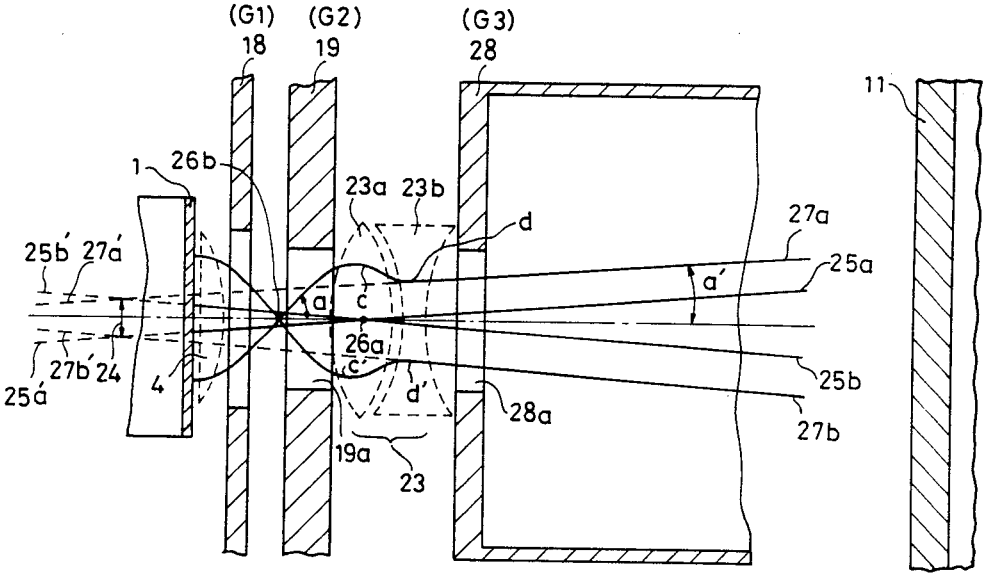
FIG. 4 is a sectional view of an electron gun embodying the present invention.
Figure 5:
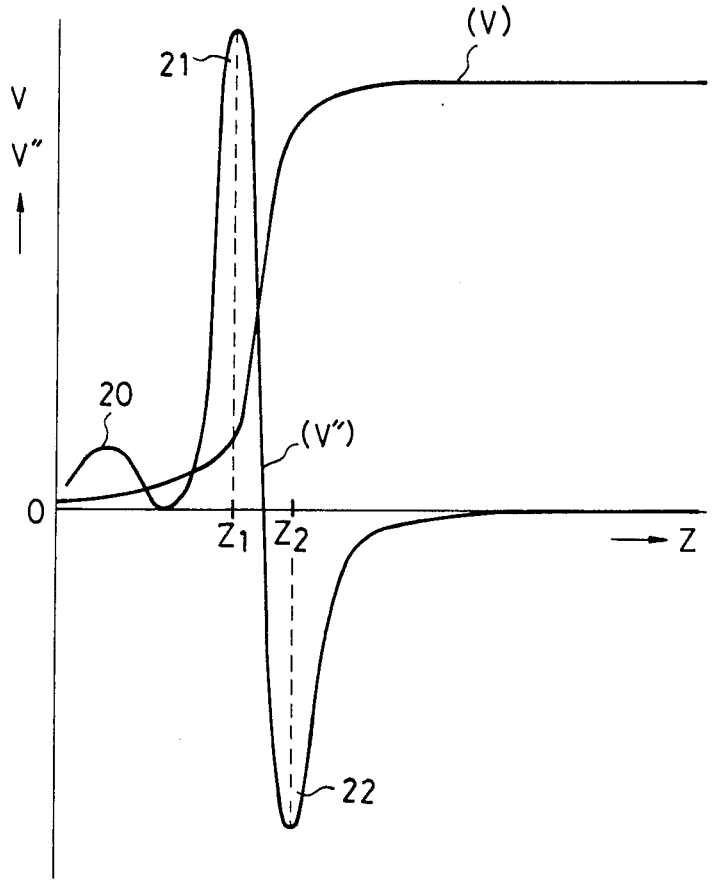
FIG. 5 is a graph showing axial potential distribution and second derivative of the potential of the electron gun of FIG. 4.

A cathode ray tube in accordance with the present invention comprises an electron gun 2 and a fluorescent screen 10 in an evacuated enclosure (not shown). The electron gun comprises at least a cathode 1, a first grid (G1) 18 as a control grid, a second grid (G2) 19 on which an accelerating potential is to be applied and a third grid (G3) 28. As shown in FIG. 4, the second grid (G2) 19 and the third grid (G3) 28 have smaller electron beam passing apertures 19*a* and 28*a* than those of prior arts, and distances between the second grid (G2) 19 and third grid (G3) 28 are considerably short in comparison with the conventional configuration. In addition, axial distribution of the axial potential V and its second derivative V″ are as shown in FIG. 5. Though the curves in the region of the cathode lens 4 are similar to those of the prior art of FIG. 2 and FIG. 3, in curves of the axial potential V and the second derivative V″ in the region of the pre-focus lens 23 the axial positions $Z_1$ and $Z_2$ of the maximum 21 and the minimum 22 are disposed close to each other. Moreover, the values of the maximum 21 and the minimum 22 of the second derivative V″ are very large, so that the area enclosed by the V″ curve and Z-axis are fairly large in both the regions including the positive peak 21 as well as the negative peak 22. By realizing such axial potential distribution, the lens action of the convex lens part 23*a* and the concave lens part 23*b* of the pre-focus lens both become very strong, and a novel function of suppressing the aberration is obtained as hereafter described, thereby minimizing the diameter of the virtual image 24 of the crossover.

Figure 1:
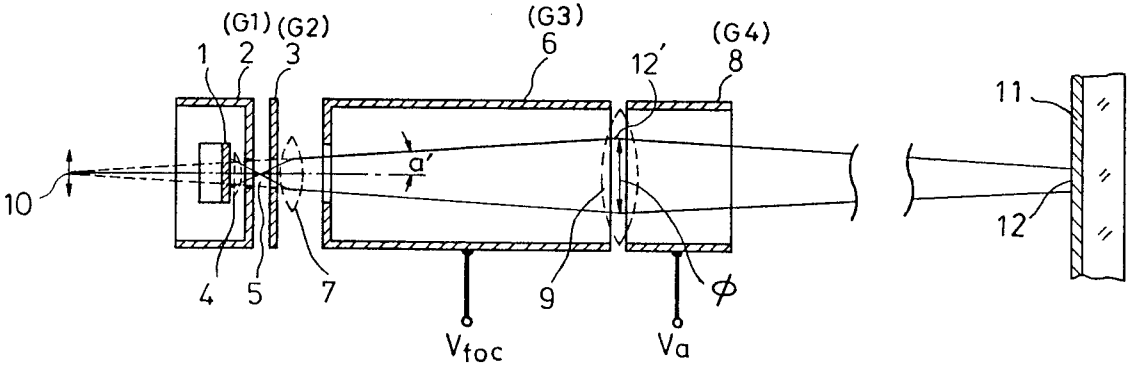
FIG.1 (Prior Art)
FIG. 1 is the sectional view of the electron gun of the conventional cathode ray tube.

The operation of the electron gun of FIG. 4 is described. Thermal electrons emitted from the central part of the face of the cathode 1 travel along electron paths 25*a* and 25*b* shown by almost straight lines, to produce a crossover at 26*a*. Thermal electrons emitted from the peripheral regions of the face of the cathode 1 travel along electron paths shown by the curves 27*a* and 27*b*, to produce a crossover at 26*b*. The thermal electron diverging from the crossover 26*b* comes in a convex lens part 23*a* where the electron beams are strongly converged, and travel along electron paths shown by the curves c and c′ where they are rapidly bent towards the axis. Thereafter, when the electrons come in the concave lens part 23*b*, they are strongly bent at the curved paths d and d′, thereby forming a slightly diverging electron beam shown by the curves 27*a* and 27*b*, and come into the third grid (G3) 28 with an incident angle of a′ and to a main lens which is substantially the same as that shown in FIG. 1.

As has been described, by configurating the pre-focus lens 23 in a manner that the component convex lens part 23*a* and the concave lens part 23*b* are each other closely disposed and the lens actions of both the convex lens 23*a* and the concave lens 23*b* are made extreme, an electron beam having a relatively small beam divergence angle a′ at the inlet part of the third grid (G3) 28 is obtainable up to a very large beam current, at which the beam divergence angle a′ has been excessively large in prior arts.

On the other hand, electron beams 25*a* and 25*b* induced by electron emissions at the central part of the cathode 1 does not substantially receive the focussing action of the pre-focus lens. Accordingly, the diameter of the crossover 24, which is determined as crossing between the extended straight lines 25*a*′ and 27*b*′ and also 25b' and 27a', become small. The straight lines 25a' and 25b' are leftward extensions of the lines 25a and 25b of the electron beam paths, and lines 27a' and 27b' are leftward extensions of the lines 27a and 27b of the electron beam paths.

Such decrease of the diameter of the virtual image 24 of the crossover is effective in suppressing adverse influence of spherical aberrations of the pre-focus lens and cathode lens.

However, if the aberration suppressing effect on the large beam current occasion is too great, the beam spot diameter at a small beam current operation becomes large. This is, because that at low beam current operation, the effective electron emitting area of the cathode becomes small, and accordingly the crossover is produced very closely to the base of the cathode 1, thereby inducing an excessive function of the pre-focus lens 7. Thereby the beam divergence angle a' is excessively minimized, and the overall lens magnification of the pre-focus lens and the main lens are excessively increased. In the present invention, by considering the above-mentioned two contradicting conditions and making many experimental studies, the following condition of design is found to provide satisfactory performance in improving the resolution power of the cathode ray tube:

$$\left.\begin{array}{l} 5 \times 10^4\ V/\text{cm} - V'\max \leqq 5 \times 10^5\ V/\text{cm} \\ 1.0\ D_1 \leqq Z_1 \leqq 2.0\ D_1 \\ 0.5\ D_1 \leqq Z_2 - Z_1 \leqq 1.2\ D_1 \end{array}\right\}, \qquad (2)$$

wherein $Z_1$ and $Z_2$ are the distances on the axis of the electron gun from electron beam emitting face of the cathode 1 to points of the maximum value and the minimum value of the second derivative, respectively, and $D_1$ is a diameter of electron passing aperture of the first grid (G1) 18.

An actual example of the electron gun embodying the present invention is as follows:

For diameter $D_1$ of the electron passing aperture of the first grid (G1) 18, diameters of apertures of the second grid (G2) 19 and the third grid (G3) 28 are both 0.7 $D_1$–1.3 $D_1$, distance between the face of the cathode 1 and the first grid (G1) 18 is 0.1 $D_1$–0.2 $D_1$, distance between the first grid (G1) 18 and the second grid (G2) 19 is 0.3 $D_1$–0.5 $D_1$, distance between the second grid (G2) 19 and the third grid (G3) 28 is 0.5 $D_1$–1.2 $D_1$, thickness of the first grid (G1) 18 is 0.1 $D_1$–0.2 $D_1$, thickness of the second grid (G2) 19 is 0.5 $D_1$–1.2 $D_1$, thickness of the third grid (G3) 28 is 0.3 $D_1$–1.0 $D_1$.

The reasons for the above-mentioned selections of the dimensional ranges are as follows:

When the diameters of apertures of the second grid (G2) and the third grid (G3) are larger than 1.3 $D_1$, the function of the convex lens is weak. When the diameters of the apertures are smaller than 0.7 $D_1$, the lens action becomes too strong, thereby enlarging the beam spot at the low current operation.

When the distance between the cathode and the first grid (G1) is larger than 0.2 $D_1$ and when the distance between the first grid (G1) and the second grid (G2) is larger than 0.5 $D_1$, the distance between the convex lens, part of the pre-focus lens and the cathode becomes excessive, and accordingly the distance between the convex lens part and the crossover becomes too long, hence resulting in excessive lens action to increase the beam spot.

When the distance between the cathode and the first grid (G1) is shorter than 0.1 $D_1$, an undesirable thermal expansion causes touching or unstability of distance between them.

When the distance between the first grid (G1) and the second grid (G2) is shorter than 0.3 $D_1$, these two grids have a possibility of undesirable touching between them, or distance between them become unstable.

When the distance between the second grid (G2) and the third grid (G3) is longer than 1.2 $D_1$, the technical advantage of the present invention is not achieved.

When the distance (G2–G3) is shorter than 0.5 $D_1$ the axial potential gradation becomes too large thereby excessively increasing the action of the composite lens 23. This excessively strengths the effect of the lens on the crossover near the cathode face at low current operation, and resultantly increases the diameter of the beam spot.

Figure 6:
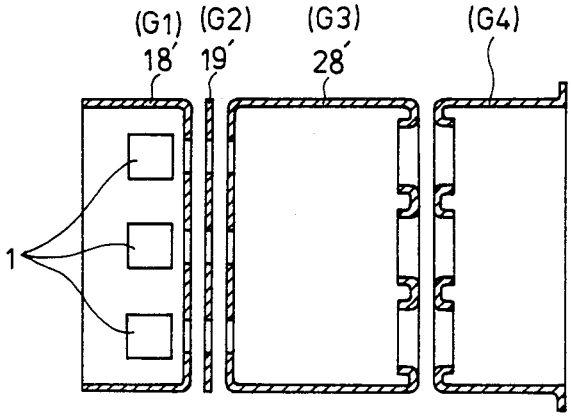
FIG. 6 is a top view of an embodiment of a three electron beam electron gun in accordance with the present invention.

The present invention can be embodied, not only in a single-electron-beam cathode ray tube, but also in a three-electron-beam cathode ray tube, such as an in-line type color cathode ray tube. FIG. 6 shows one example of the electron gun configuration for such three-electron-beam cathode ray tube, wherein all of a first grid (G1) 18', a second grid (G2) 19', a third grid (G3) 28' and a fourth grid (G4) have three electron passing apertures disposed in one line in horizontal direction.

The above-mentioned electron gun is operated by impressing the following potentials to respective electrodes:

| | |
|---|---|
| cathode | 20–200 V |
| first grid (G1) | 0 V |
| second grid (G2) | 300–800 V |
| third grid (G3) | 6–8 KV |
| fourth grid (G4) | 20–30 KV. |

The cathode ray tube comprising the above-mentioned electron gun and operated in the above-mentioned conditions realized satisfactorily small beam spots having a diameter of 35–45% of that of the conventional cathode ray tube, even at a large beam current operation of 4 mA.

As has been described in detail on the concrete embodiment, the cathode ray tube in accordance with the present invention has very small beam spot, both at small beam current operation and large beam current operation, and therefore very high resolution is obtainable.

What is claimed is:

1. A cathode ray tube comprising an electron gun, a fluorescent screen and an evacuated enclosure enclosing said electron gun and said fluorescent screen therein, said electron gun comprising at least a cathode, a first grid (G1) as a control grid, a second grid (G2) on which an accelerating potential is to be applied, a third grid (G3) on which a focussing potential is to be applied, which are disposed in this sequential order and impressed with such predetermined potentials that:

maximum of the first derivative of the axial potential of said electron gun within a range between said second grid (G2) and said third grid (G3) is in a range from $5\times10^4$ V/cm to $5\times10^5$ V/cm, and maximum value and minimum value of the second derivative of said axial potential of said electron gun are located at the distances on the axis determined from following relations:

$$1.0\ D_1 \leqq Z_1 \leqq 2.0\ D_1$$

and $$0.5\ D_1 \leqq Z_2 - Z_1 \leqq 1.2\ D_1,$$

wherein $Z_1$ and $Z_2$ are the distances on the axis of said electron gun from electron beam emitting face of said cathode to points of said maximum value and a minimum value of said second derivative, respectively, and $D_1$ is diameter of electron passing aperture of said first grid (G1).

2. A cathode ray tube in accordance with claim 1, wherein said electron gun is of bipotential type.

3. A cathode ray tube in accordance with claim 1, wherein said electron gun has plural electron beam paths.

4. A cathode ray tube in accordance with claim 2, wherein said diameters of said second grid (G2) and said third grid (G3) are 0.7 $D_1$–1.3 $D_1$ wherein $D_1$ is the diameter of said first grid (G1).

5. A cathode ray tube in accordance with claim 4, wherein distance between face of said cathode and said first grid (G1) is 0.1 $D_1$–0.2 $D_1$, distance between said first grid (G1) and said second grid (G2) is 0.3 $D_1$–0.5 $D_1$ and distance between said second grid (G2) and said third grid (G3) is 0.5 $D_1$–1.2 $D_1$.

6. A cathode ray tube in accordance with claim 5, wherein said first grid (G1) has a thickness of 0.1 $D_1$–0.2 $D_1$, said second grid (G2) has a thickness of 0.5 $D_1$–1.2 $D_1$ and said third grid (G3) has a thickness of 0.3 $D_1$–1.0 $D_1$.

7. A cathode ray tube in accordance with claim 2, wherein said first grid (G1) is impressed with 0 V, said second grid (G2) is impressed with 300 V–800 V and said third grid (G3) is impressed with 6 KV–8 KV.

* * * * *